US007191833B2

(12) United States Patent
Richards

(10) Patent No.: US 7,191,833 B2
(45) Date of Patent: Mar. 20, 2007

(54) SAND CONTROL SCREEN ASSEMBLY HAVING FLUID LOSS CONTROL CAPABILITY AND METHOD FOR USE OF SAME

(75) Inventor: William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 126 days.

(21) Appl. No.: 10/925,166

(22) Filed: Aug. 24, 2004

(65) Prior Publication Data

US 2006/0042795 A1 Mar. 2, 2006

(51) Int. Cl.
*E21B 43/08* (2006.01)

(52) U.S. Cl. ..... 166/278; 166/51; 166/233; 166/115; 166/202

(58) Field of Classification Search ..... 166/51, 166/227, 231, 233, 235, 278, 115, 202
See application file for complete search history.

(56) References Cited

U.S. PATENT DOCUMENTS

| | | | | |
|---|---|---|---|---|
| 1,975,162 | A | 10/1934 | Layne | |
| 2,342,913 | A | 2/1944 | Williams et al. | |
| 2,344,909 | A | 3/1944 | Williams et al. | |
| 3,005,507 | A | 10/1961 | Clark, Jr. et al. | |
| 3,486,558 | A | 12/1969 | Maxwell | |
| 3,627,046 | A | 12/1971 | Miller et al. | |
| 3,865,188 | A | 2/1975 | Doggett et al. | |
| 4,418,754 | A | 12/1983 | Stepp | |
| 4,428,428 | A * | 1/1984 | Smyrl et al. | 166/278 |
| 4,494,608 | A | 1/1985 | Williams et al. | |
| 4,553,595 | A | 11/1985 | Huang et al. | |
| 4,558,742 | A | 12/1985 | Huang et al. | |
| 4,627,488 | A | 12/1986 | Szarka | |
| 4,646,839 | A | 3/1987 | Rickey | |
| 4,858,690 | A | 8/1989 | Rebardi et al. | |

(Continued)

FOREIGN PATENT DOCUMENTS

EP 0 431 162 6/1991

(Continued)

OTHER PUBLICATIONS

U.S. Appl. No. 10/252,621, Brezinski et al.

(Continued)

*Primary Examiner*—David Bagnell
*Assistant Examiner*—Matthew J. Smith
(74) *Attorney, Agent, or Firm*—Lawrence R. Youst

(57) ABSTRACT

A sand control screen assembly (60) that is positionable within a wellbore includes a base pipe (62) having at least one opening (64) that allows fluid flow therethrough and a filter medium (66) positioned exteriorly of the base pipe (62) that selectively allows fluid flow therethrough and prevents particulate flow of a predetermined size therethrough. An isolation member (68) is positioned interiorly of the base pipe (62) forming an annulus (84) therewith. A one-way valve (86) is slidably operable within the annulus (84). The one-way valve (86) controls the flow of fluid through sand control screen assembly (60) such that fluid flow is selectively prevented from the interior to the exterior of the sand control screen assembly (60) but is allowed from the exterior to the interior of the sand control screen assembly (60).

43 Claims, 7 Drawing Sheets

U.S. PATENT DOCUMENTS 4,886,432 A 12/1989 Kimberlin
4,932,474 A 6/1990 Schroeder, Jr. et al.
4,945,991 A 8/1990 Jones
5,082,052 A 1/1992 Jones et al.
5,113,935 A 5/1992 Jones et al.
5,161,613 A 11/1992 Jones
5,161,618 A 11/1992 Jones et al.
5,228,526 A 7/1993 Vshivkov et al.
5,332,039 A 7/1994 Primeaux et al.
5,333,688 A 8/1994 Jones et al.
5,343,949 A 9/1994 Ross et al.
5,355,953 A 10/1994 Shy et al.
5,355,956 A 10/1994 Restarick
5,386,874 A 2/1995 Laramay et al.
5,390,966 A 2/1995 Cox et al.
5,419,394 A 5/1995 Jones
5,435,393 A 7/1995 Brekke et al.
5,443,117 A 8/1995 Ross
5,476,143 A 12/1995 Sparlin et al.
5,515,915 A 5/1996 Jones et al.
5,588,487 A 12/1996 Bryant
5,636,691 A 6/1997 Hendrickson et al.
5,676,208 A 10/1997 Finley
5,699,860 A 12/1997 Grundmann
5,722,490 A 3/1998 Ebinger
5,730,223 A 3/1998 Restarick
5,755,286 A 5/1998 Ebinger
5,842,516 A 12/1998 Jones
5,848,645 A 12/1998 Jones
5,865,251 A 2/1999 Ribardi et al.
5,868,200 A 2/1999 Bryant et al.
5,890,533 A 4/1999 Jones
5,896,928 A 4/1999 Coon
5,906,238 A 5/1999 Carmody et al.
5,921,318 A 7/1999 Ross
5,934,376 A 8/1999 Nguyen et al.
5,988,285 A 11/1999 Tucket et al.
6,003,600 A 12/1999 Nguyen et al.
6,047,773 A 4/2000 Zeltmann et al.
6,059,032 A 5/2000 Jones
6,112,815 A 9/2000 B.o slashed.e et al.
6,112,817 A 9/2000 Voll et al.
6,116,343 A 9/2000 Van Petegem et al.
6,125,933 A 10/2000 Ross
6,220,345 B1 4/2001 Jones et al.
6,227,303 B1 5/2001 Jones
6,230,803 B1 5/2001 Morton et al.
6,286,594 B1 9/2001 French
6,302,208 B1 10/2001 Walker et al.
6,325,150 B1 12/2001 Rayssiguier
6,343,651 B1 2/2002 Bixenman
6,371,210 B1 * 4/2002 Bode et al. ..... 166/233
6,397,950 B1 6/2002 Streich et al.
6,446,729 B1 9/2002 Bixenman et al.
6,450,263 B1 9/2002 Schwendemann
6,457,518 B1 10/2002 Castano-Mears et al.
6,464,007 B1 10/2002 Jones
6,478,091 B1 11/2002 Gano
6,488,082 B2 12/2002 Echols et al.
6,494,261 B1 12/2002 Pahmiyer
6,540,022 B2 4/2003 Dusterhoft et al.
6,543,538 B2 4/2003 Tolman et al.
6,547,011 B2 4/2003 Kilgore
6,557,634 B2 5/2003 Hailey, Jr. et al.
6,622,794 B2 9/2003 Zisk, Jr.
6,644,412 B2 11/2003 Bode et al.
6,681,854 B2 1/2004 Danos
6,695,054 B2 2/2004 Johnson et al.
6,719,051 B2 4/2004 Hailey, Jr. et al.
6,786,285 B2 9/2004 Johnson et al.
6,857,476 B2 2/2005 Richards
6,877,553 B2 4/2005 Cameron
6,886,634 B2 5/2005 Richards
6,899,176 B2 5/2005 Hailey, Jr. et al.
6,966,380 B2 11/2005 McLoughlin et al.
7,055,598 B2 * 6/2006 Ross et al. ..... 166/233
2002/0074119 A1 6/2002 Bixenman et al.
2002/0092649 A1 7/2002 Bixenman et al.
2002/0096329 A1 7/2002 Coon et al.
2002/0125006 A1 9/2002 Hailey, Jr. et al.
2002/0125008 A1 9/2002 Wetzel et al.
2002/0157837 A1 10/2002 Bode et al.
2002/0174981 A1 11/2002 Den Boer et al.
2002/0189815 A1 12/2002 Johnson et al.
2003/0000701 A1 1/2003 Dusterhoft et al.
2003/0000875 A1 1/2003 Echols et al.
2003/0056947 A1 3/2003 Cameron
2003/0056948 A1 3/2003 Cameron
2003/0075324 A1 4/2003 Dusterhoft et al.
2003/0089496 A1 5/2003 Price-Smith et al.
2003/0141061 A1 7/2003 Hailey, Jr. et al.
2003/0141062 A1 7/2003 Cowna et al.
2003/0188871 A1 10/2003 Dusterhoft et al.
2004/0020832 A1 2/2004 Richards et al.
2004/0035578 A1 2/2004 Ross et al.
2004/0035591 A1 2/2004 Echols
2004/0173350 A1 9/2004 Wetzel et al.
2006/0185849 A1 8/2006 Edwards et al.

FOREIGN PATENT DOCUMENTS

EP 0 617 195 9/1994
EP 1 132 571 9/2001
EP 0 955 447 3/2004
EP 1 352 150 B1 9/2005
GB 2 371 319 7/2002
GB 2 371 578 7/2002
GB 2 381 021 4/2003
GB 2 381 811 5/2003
WO WO 99/12630 3/1999
WO WO 00/61913 10/2000
WO WO 01/14691 3/2001
WO WO 01/042620 6/2001
WO WO 01/44619 6/2001
WO WO 01/49970 7/2001
WO WO 02/10554 2/2002
WO WO 02/055842 7/2002
WO WO 02/057594 7/2002

OTHER PUBLICATIONS

Restarick, H.L. of Otis Engineering Corp; "Mechanical Fluid-Loss Control Systems Used During Sand Control Operations"; 1992; pp. 21-36.

"Sand Control Screens"; Halliburton Energy Services, Inc.; 1994; 4 pages.

Ebinger, Charles D. of Ely & Associates Inc.; "Frac Pack Technology Still Evolving"; Oil & Gass Journal; Oct. 23, 1995; pp. 60-70.

Hailey, Travis et al. of Halliburton Energy Services, Inc.; "Screenless Single Trip Multizone Sand Control Tool System Saves Rig Time"; Society of Petroleum Engineers Inc.; Feb. 2000; pp. 1-11.

"CAPS Sand Control Services for Horizontal Completions Improves Gravel Pack Reliability and Increases Production Potential from Horizontal Completions"; Halliburton Energy Services, Inc.; Aug. 2000; 2 pages.

"CAPS Concentria Annual Packing Service for Sand Control"; Halliburton Energy Services, Inc.; Aug. 2000; 4 pages.

Saldungaray, Pedro M. et al. of Schlumberger, "Simultaneous Gravel Packing and Filter Cake Removal in Horizontal Wells Applying Shunt Tubes and Novel Carrier and Breaker Fluid"; Mar. 2001: pp. 1-6.

"Quantum Zonal Isolation Tool"; pp. 12-13 of Sand Face Competions Catalog.

"Absolute Isolation System (ASI) Components"; Halliburton Energy Services, Inc.; pp. 5-28 of Downhole Sand Control Components.

"OSCA HPR-ISO System"; Technical Bulletin; 1 page.

"OSCA The ISO System"; Technical Bulletin; 1 page.

"OSCA Screen Communication System"; Technical Bulletin; 1 page.

"OSCA Pressure Actuated Circulating Valve"; Technical Bulletin; 1 page.

* cited by examiner

SAND CONTROL SCREEN ASSEMBLY HAVING FLUID LOSS CONTROL CAPABILITY AND METHOD FOR USE OF SAME

TECHNICAL FIELD OF THE INVENTION

This invention relates, in general, to a sand control screen assembly positioned in a production interval of a wellbore and, in particular, to a sand control screen assembly having fluid loss control capability that selectively prevents fluid flow from the interior to the exterior of the sand control screen assembly.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In other cases, it may be desirable to stimulate the formation by, for example, performing a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

It has been found, however, that following formation treatment operations, the fluid inside the sand control screen tends to leak off into the adjacent formation. This leak off not only results in the loss of the relatively expensive fluid into the formation, but may also result in damage to the gravel pack around the sand control screen and damage to the formation. This fluid leak off is particularly problematic in cases where multiple production intervals within a single wellbore require treatment, as the fluid remains in communication with the various formations for an extended period of time.

Therefore, a need has arisen for an apparatus and a treatment method that provide for the treatment of one or more formations traversed by a wellbore. A need has also arisen for such an apparatus and a treatment method that prevent fluid loss into the formations following the treatment process. Further, need has also arisen for such an apparatus and a treatment method that allow for the production of fluids from the formations in combination with sand control following the treatment process.

SUMMARY OF THE INVENTION

The present invention disclosed herein comprises a sand control screen assembly and a treatment method that provide for the treatment of one or more formations traversed by a wellbore. The sand control screen assembly and the treatment method of the present invention prevent fluid loss into the formations following the treatment process. In addition, the sand control screen assembly and the treatment method of the present invention allow for the production of fluids from the formations in combination with sand control following the treatment process.

The sand control screen assembly of the present invention includes a base pipe having at least one opening that allows fluid flow therethrough. A filter medium is positioned exteriorly of the base pipe. The filter medium selectively allows fluid flow therethrough and prevents particulate flow of a predetermined size therethrough. An isolation member is positioned interiorly of the base pipe and forms an annular region therewith. A one-way valve is slidably operable within the annular region. The one-way valve controls fluid flow between the exterior and the interior of the sand control screen assembly.

The one-way valve has a non sealing position and a sealing position. In the sealing position, the one-way valve prevents fluid flow from the interior to the exterior of the sand control screen assembly. The one-way valve is actuatable from the sealing position to the non sealing position to allow fluid flow from the exterior to the interior of the sand control screen assembly. In one embodiment, the one-way valve includes a spring retainer, a biasing member and a shuttle valve. In this embodiment, the biasing member urges the shuttle valve into the sealing position.

In another aspect, the sand control screen assembly of the present invention includes a base pipe having at least one opening that allows fluid flow therethrough. A filter medium is positioned exteriorly of the base pipe. The filter medium selectively allows fluid flow therethrough and prevents particulate flow of a predetermined size therethrough. An isolation member is positioned interiorly of the base pipe and forms an annular region therewith. A seal member is slidably operable within the annular region. The seal member controls fluid flow between the exterior and the interior of the sand control screen assembly. In addition, the seal member has a one-way valve configuration and a valve open configuration.

In the one-way valve configuration, the seal member prevents fluid loss from the interior to the exterior of the sand control screen assembly. In the valve open configuration, the seal member allows fluid flow from the interior to the exterior of the sand control screen assembly and from the exterior to the interior of the sand control screen assembly. The seal member is operable from the one-way valve configuration to the valve open configuration responsive to a differential pressure between the interior and the exterior of the sand control screen assembly that exceeds a predetermined threshold or via a mechanical operation.

In one embodiment, the seal member includes a spring retainer, a biasing member and a shuttle valve. In the one-way valve configuration of the seal member, the spring retainer is in a first position relative to the base pipe such that the biasing member urges the shuttle valve into a sealing position. In the valve open configuration of the seal member, the spring retainer is in a second position relative to the base pipe such that the biasing member does not urge the shuttle valve into the sealing position.

In one embodiment, the spring retainer is releasably secured to either the base pipe or the isolation member with one or more shear pins when the spring retainer is in the first position. The spring retainer is operated from the first position to the second position by the application of a differential pressure above a predetermined threshold between the interior and the exterior of the sand control screen assembly or by mechanically shifting the spring retainer relative to the base pipe. In another embodiment, the spring retainer is secured to either the base pipe or the isolation member with one or more collet fingers when the spring retainer is in the second position.

When the spring retainer is in the second position, the shuttle valve may be operated to a disabled position. In one embodiment, the shuttle valve is operated to the disabled position responsive to a differential pressure above a predetermined threshold between the exterior and the interior of the sand control screen assembly or by mechanical shifting the shuttle valve relative to the base pipe. Once in the disabled position, the shuttle valve may be secured to the base pipe with a keeper ring.

In one embodiment, the isolation member may be a tubular having at least one opening. In another embodiment, the isolation member may be a pair of tubulars having a gap therebetween. In a further embodiment, the isolation member may be a tubular having an end that is in fluid communication with the interior of the sand control screen. In yet another embodiment, at least a portion of the isolation member may be retrievable from within the base pipe which will allow fluid flow from the interior to the exterior and from the exterior to the interior of the sand control screen assembly.

In a further aspect, the present invention is directed to a downhole treatment method that includes locating a sand control screen assembly within a production interval of a wellbore, pumping a treatment fluid into the production interval, allowing fluid returns to enter the interior of the sand control screen assembly by slidably actuating a one-way valve disposed in an annular region between a base pipe and an internal isolation member, preventing fluid loss from the interior to the exterior of the sand control screen assembly with the one-way valve in a sealing position and allowing production fluids to enter the interior of the sand control screen assembly by slidably actuating the one-way valve to the non sealing position.

In yet another aspect, the present invention is directed to a downhole treatment method that includes locating a sand control screen assembly within a production interval of a wellbore, pumping a treatment fluid into the production interval, allowing fluid returns to enter the interior of the sand control screen assembly by slidably actuating a seal member disposed in an annular region between a base pipe and an internal isolation member, preventing fluid loss from the interior to the exterior of the sand control screen assembly with the seal member, allowing production fluids to enter the interior of the sand control screen assembly by slidably actuating the seal member, operating the seal member from the one-way valve configuration to a valve open configuration and allowing fluid flow from the interior to the exterior of the sand control screen assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
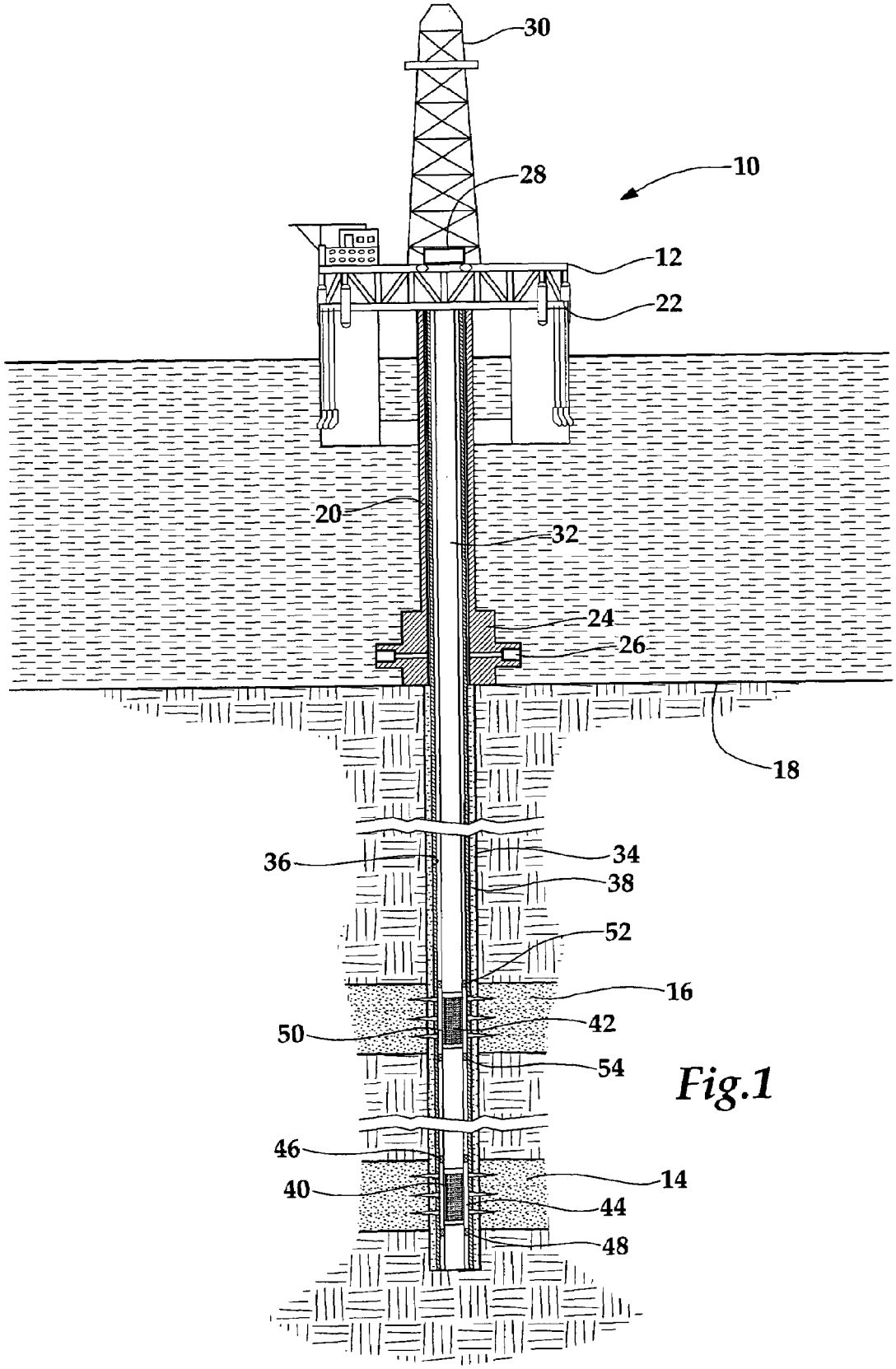
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore and operating from an offshore oil and gas platform is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes various tools such as a sand control screen assembly 40 which is positioned within production interval 44 between packers 46, 48 and adjacent to formation 14 and sand control screen assembly 42 which is positioned within production interval 50 between packers 52, 54 and adjacent to formation 16. Once sand control screen assemblies 40, 42 are in the illustrated configuration, a treatment fluid containing sand, gravel, proppants or the like may be pumped down work string 32 such that production intervals 44, 50 and formations 14, 16 may be treated, as described in greater detail below.

Even though FIG. 1 depicts a vertical well, it should be noted by one skilled in the art that the sand control screen assemblies of the present invention are equally well-suited for use in wells having other directional orientations such as deviated wells, inclined wells or horizontal wells. Also, even though FIG. 1 depicts an offshore operation, it should be noted by one skilled in the art that the sand control screen assemblies of the present invention are equally well-suited for use in onshore operations. Further, even though FIG. 1 depicts two formations, it should be understood by one skilled in the art that the treatment processes of the present invention are equally well-suited for use in wellbores traversing any number of formations.

Figure 2:
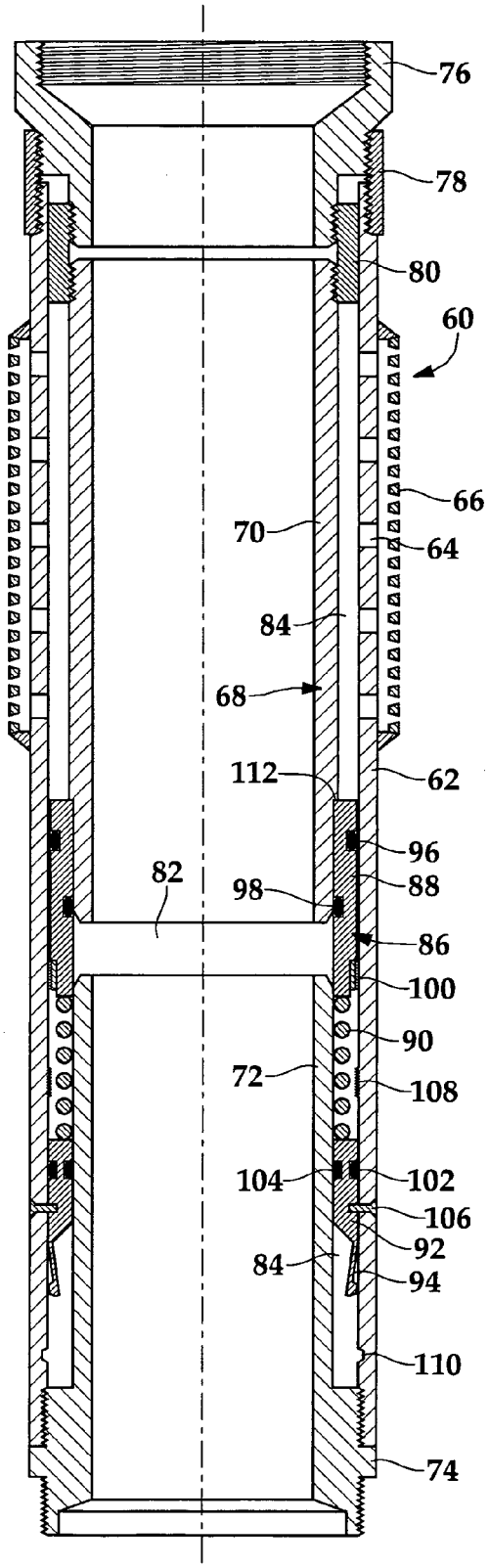
FIG. 2 is a half sectional view of a sand control screen assembly of the present invention having a seal member in a first operating configuration.

Referring now to FIG. 2, therein is depicted a more detailed illustration of a sand control screen assembly of the present invention that is generally designated 60. Sand control screen assembly 60 includes a base pipe 62 that has a plurality of openings 64 which allow the flow of production fluids into sand control screen assembly 60. The exact number, size and shape of openings 64 are not critical to the present invention, so long as sufficient area is provided for fluid production and the integrity of base pipe 62 is maintained.

Positioned exteriorly of a portion of base pipe 62 is a filter medium 66. Filter medium 66 may be any type of filtration structure that is presently known in the art or subsequently discovered. For example, filter medium 66 may consist of a screen wire wrapped around a plurality of ribs forming turns that have gap therebetween through which formation fluids flow. The number of turns and the gap between the turns are determined based upon the characteristics of the formation from which fluid will be produced and the size of the gravel to be used during the gravel packing operation. As another alternative, filter medium 66 may consist of a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough. Filter medium 66 may be attached to base pipe 62 by any suitable means such as by welding.

Positioned within base pipe 62 is an internal isolation member 68. In the illustrated embodiment, isolation member 68 includes an upper section 70 and a lower section 72. Base pipe 62 is threadably coupled to lower section 72 at lower connector 74. At the opposite end, base pipe 62 is threadably coupled to upper connector 76 via coupling 78. Upper connector 76 is threadably coupled to upper section 70 of isolation member 68 via coupling 80. Upper section 70 and a lower section 72 are separated by a gap 82 that is in fluid communication with the interior of sand control screen assembly 60. Alternatively, sand control screen assembly 60 could have an internal isolation member having other configurations including single member configurations having one or more openings to allow fluid flow therethrough.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that while the sand control screen assembly of the present invention will likely have the described vertical orientation when assembled on the rig floor, once downhole, the sand control screen assembly of the present invention is not limited to such orientation as it is equally-well suited for use in inclined and horizontal orientations.

Base pipe 62 and isolation member 68 are attached to upper connector 76 and lower connector 74 such that an annulus 84 is formed between base pipe 62 and isolation member 68. Disposed within annulus 84 is a seal member 86 that performs the functions of a one-way valve and an open valve. Seal member 86 includes an annular sleeve referred to as shuttle valve 88, a biasing member 90 depicted as a spiral wound compression spring and a spring retainer 92 having collet fingers 94. Shuttle valve 88 has a seal 96 positioned on the exterior thereof that provides a seal against an interior sealing surface of base pipe 62. Shuttle valve 88 also has a seal 98 positioned on the interior thereof that provides a seal against the exterior sealing surface of upper section 70 of isolation member 68.

Positioned between shuttle valve 88 and base pipe 62 is a keeper ring 100. Spring retainer 92 has a seal 102 positioned on the exterior thereof that provides a seal against the interior sealing surface of base pipe 62. Spring retainer 92 also has a seal 104 positioned on the interior thereof that provides a seal against the exterior sealing surface of lower section 72 of isolation member 68. In the illustrated embodiment, a plurality of shear pins 106 extend through openings of base pipe 62 and initially into a shear pin receiving groove in the exterior surface of spring retainer 92. Alternate arrangements for selectively retaining spring retainer 92 in its initial position could alternatively be used including releasably coupling spring retainer 92 to isolation member 68 using shear pins or other retaining devices. Base pipe 62 also has a mating profile 108 and a collet finger receiving groove 110.

The operation of sand control screen assembly 60 will now be described with reference to FIGS. 2–5. FIG. 2 depicts sand control screen assembly 60 in its run-in position. Specifically, spring retainer 92 is secured to base pipe 62 with shear pins 106. This causes spring 90 to upwardly bias shuttle valve 88 against radially outwardly extending shoulder 112 of upper section 70 of isolation member 68. In this position, a seal is created between shuttle valve 88 and the sealing surface of base pipe 62 by seal 96. In addition, a seal is created between shuttle valve 88 and the sealing surface of upper section 70 of isolation member 68 by seal 98. Once sand control screen assembly 60 is properly positioned downhole adjacent to a production interval, a treatment process such as a gravel pack, frac pack, fracture stimulation operation or the like may then take place.

Figure 3:
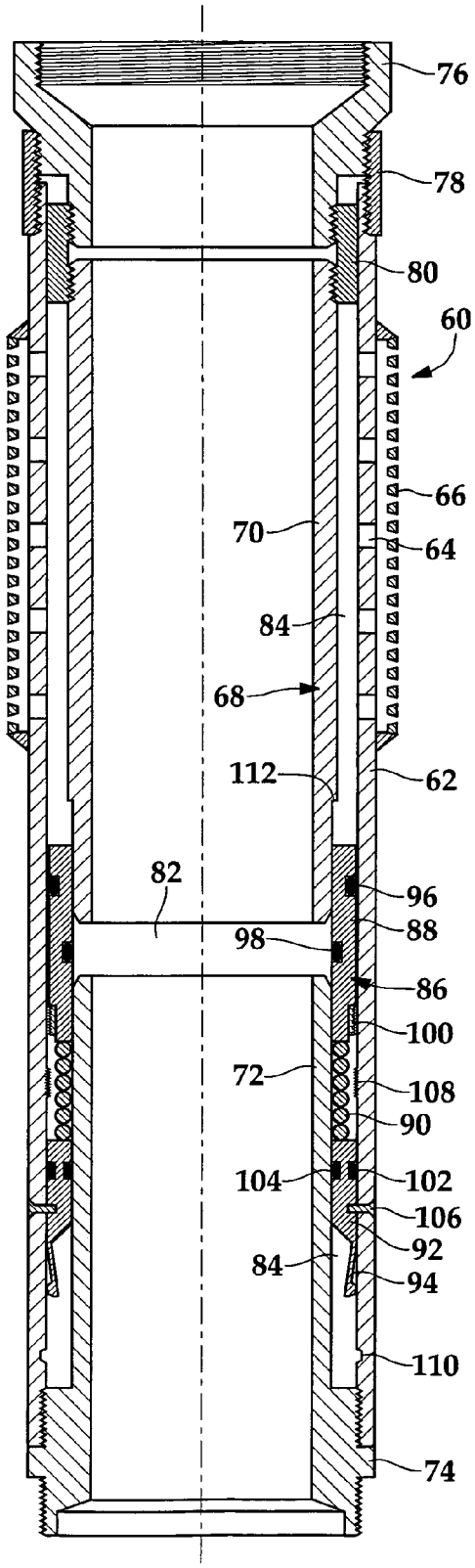
FIG. 3 is a half sectional view of a sand control screen assembly of the present invention having a seal member in a second operating configuration.

During the treatment operation, returns may be taken through sand control screen assembly 60, as best seen in FIG. 3. Specifically, spring retainer 92 remains secured to base pipe 62 with shear pins 106 allowing spring 90 to continue to upwardly bias shuttle valve 88. The fluid pressure created by the returns that pass through filter medium 66, opening 64 of base pipe 62 and annulus 84, however, downwardly biases shuttle valve 88 to unseat shuttle valve 88. Specifically, shuttle valve 88 is actuated from the sealing position of FIG. 2, wherein seal 98 contacts the sealing surface of isolation member 68, to the non sealing position of FIG. 3, wherein seal 98 does not contact the sealing surface of isolation member 68. In the non sealing position, the returns flow through gap 82 and into the interior of sand control screen assembly 60 for return to the surface. Once the treatment process is complete, the bias force of spring 90 will operate shuttle valve 88 back to the sealing position depicted in FIG. 2. In this position, fluid loss from the interior to the exterior of sand control screen assembly 60 is prevented as a seal is created between shuttle valve 88 and the sealing surface of base pipe 62 by seal 96 and a seal is created between shuttle valve 88 and the sealing surface of upper section 70 of isolation member 68 by seal 98. Accordingly, spring retainer 92, spring 90 and shuttle valve 88 form an annular one-way valve that slidably operates within annulus 84.

When it is desirable to commence production from the interval adjacent to sand control screen assembly 60, the pressure of the formation fluid is sufficient to overcome the bias force of spring 90 such that shuttle valve 88 is moved off seat. This allows the production fluids to flow through gap 82 of isolation member 68 into the interior of sand control screen assembly 60 for transport to the surface, as best seen in FIG. 3.

Figure 4:
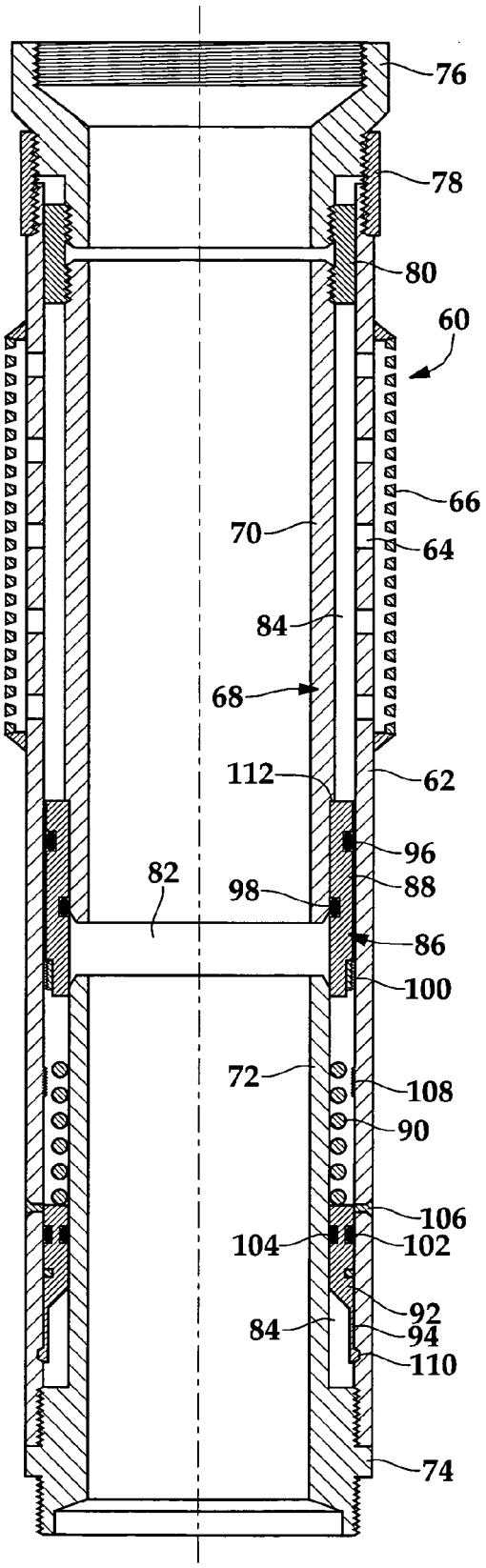
FIG. 4 is a half sectional view of a sand control screen assembly of the present invention having a seal member in a third operating configuration.

It should be noted that following the treatment processes wherein fluid flow from the interior to the exterior of sand control screen assembly 60 is prevented, the ability to flow fluids from the interior to the exterior of sand control screen assembly 60 may be desirable, for example, to perform additional treatment operations such as an acid treatment. In this case, sand control screen assembly 60 may be operated to its valve open configuration. As best seen in FIG. 4, a tubing pressure is applied within sand control screen assembly 60. This pressure enters annulus 84 via gap 82 to act on spring retainer 92. When the downwardly acting force on spring retainer 92 is sufficient, shear pins 106 will break which causes spring retainer 92 and spring 90 to move downwardly relative to base pipe 62 until collet fingers 94 engage collet finger receiving groove 110. In this configuration, spring retainer 92 is prevented from further axial movement relative to base pipe 62. In addition, spring 90 no longer applies an upward bias force against shuttle valve 88.

Figure 5:
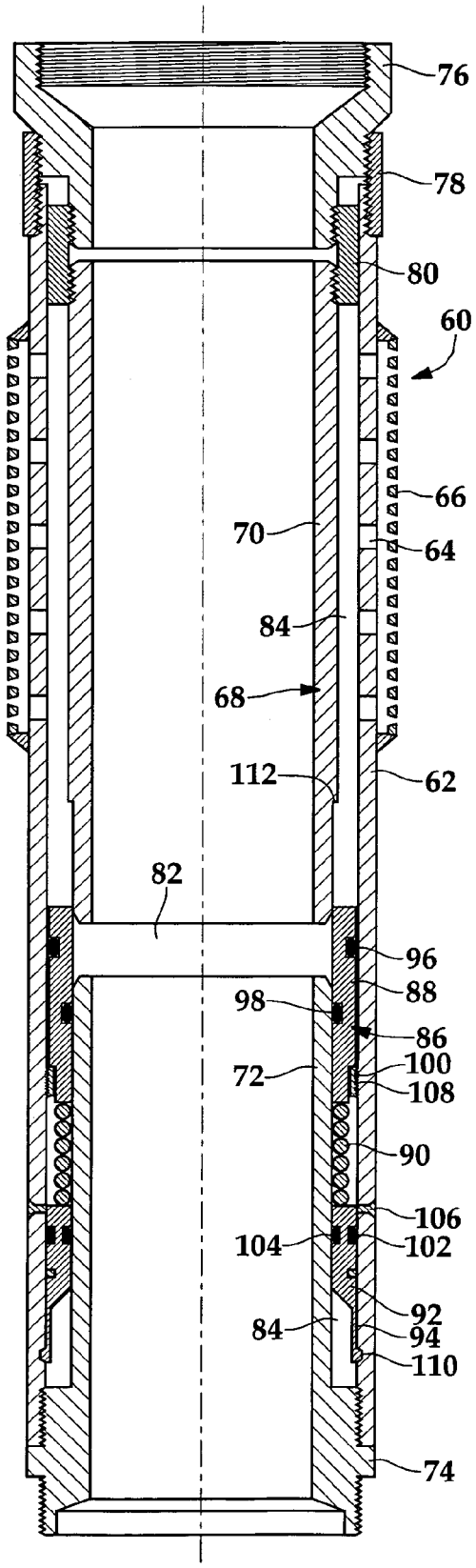
FIG. 5 is a half sectional view of a sand control screen assembly of the present invention having a seal member in a fourth operating configuration.

As best seen in FIG. 5, once the tubing pressure is released, wellbore pressure acting on shuttle valve 88 will shift shuttle valve 88 axially downward until shuttle valve 88 contacts spring 90 which prevent further downward movement of shuttle valve 88. In addition, as keeper ring 100 has engaged mating profile 108 of base pipe 92, this prevents upward movement of shuttle valve 88, thereby operating shuttle valve 88 to a disabled position. In this configuration, production fluid may flow into the interior of sand control screen assembly 60 through gap 82 uninhibited by shuttle valve 88. Likewise, a treatment fluid such as acid may flow from the interior to the exterior of sand control screen assembly 60.

Accordingly, when sand control screen assembly 60 of the present invention is used during a treatment process such as a gravel pack, a frac pack or a fracture operation, treatment fluid returns are allowed to flow into sand control screen assembly 60 by seal member 86. Also, when sand control screen assembly 60 of the present invention is used following a treatment process, fluids are prevented from flowing from the interior to the exterior of sand control screen assembly 60 by seal member 86. Additionally, when sand control screen assembly 60 is used during production, production fluids are allowed to flow into sand control screen assembly 60 by seal member 86. Further, when sand control screen assembly 60 of the present invention is used during a subsequent treatment process, seal member 86 may be disabled.

Figure 6:
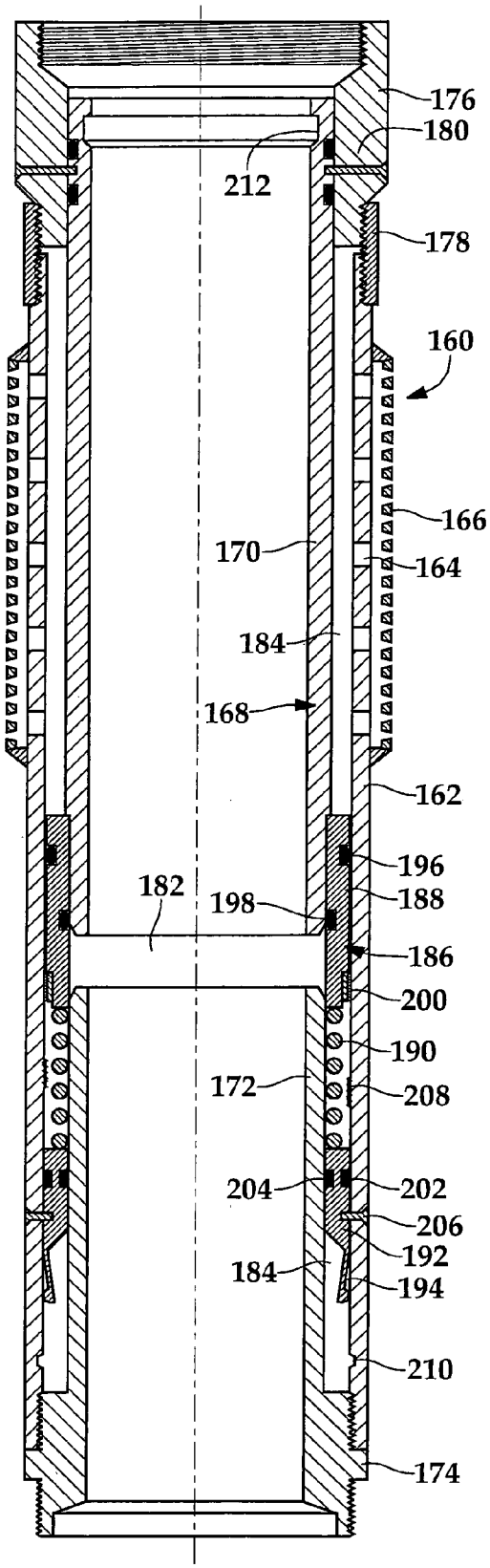
FIG. 6 is a half sectional view of another embodiment of a sand control screen assembly of the present invention having a seal member.

Referring now to FIG. 6, therein is depicted another embodiment of a sand control screen assembly of the present invention that is generally designated 160. Sand control screen assembly 160 includes a base pipe 162 that has a plurality of openings 164 which allow the flow of production fluids into sand control screen assembly 160. Positioned exteriorly of base pipe 162 is a filter medium 166. Positioned within base pipe 162 is an internal isolation member 168. In the illustrated embodiment, isolation member 168 includes an upper section 170 and a lower section 172. Base pipe 162 is threadably coupled to lower section 172 at lower connector 174. At the opposite end, base pipe 162 is threadably coupled to upper connector 176 via coupling 178. Upper connector 176 is coupled to upper section 170 of isolation member 168 via a plurality of shear pins 180. Upper section 170 and a lower section 172 are separated by a gap 182 that is in fluid communication with the interior of sand control screen assembly 160.

Base pipe 162 and isolation member 168 are attached to upper connector 176 and lower connector 174 such that an annulus 184 is formed between base pipe 162 and isolation member 168. Disposed within annulus 184 is a seal member 186 that performs the functions of a one-way valve and an open valve. Seal member 186 includes a shuttle valve 188, a biasing member 190 and a spring retainer 192 having collet fingers 194. Shuttle valve 188 has a seal 196 positioned on the exterior thereof that provides a seal against an interior sealing surface of base pipe 162. Shuttle valve 188 also has a seal 198 positioned on the interior thereof that provides a seal against the exterior sealing surface of upper section 170 of isolation member 168.

Positioned between shuttle valve 198 and base pipe 162 is a keeper ring 200. Spring retainer 192 has a seal 202 positioned on the exterior thereof that provides a seal against the interior sealing surface of base pipe 162. Spring retainer 192 also has a seal 204 positioned on the interior thereof that provides a seal against the exterior sealing surface of lower section 172 of isolation member 168. In the illustrated embodiment, a plurality of shear pins 206 extend through openings of base pipe 162 and initially into a shear pin receiving groove in the exterior surface of spring retainer 192. Base pipe 162 also has a mating profile 208 and a collet finger receiving groove 210.

The operation of sand control screen assembly 160 is substantially the same as that of sand control screen assembly 60 described above. Specifically, when sand control screen assembly 160 of the present invention is used during a treatment process such as a gravel pack, a frac pack or a fracture operation, treatment fluid returns are allowed to flow into sand control screen assembly 160 by seal member 186 in its non sealing position. Also, when sand control screen assembly 160 of the present invention is used following a treatment process, fluids from the interior of sand control screen assembly 60 are prevented from flowing out of sand control screen assembly 160 by seal member 186 in its sealing position. Additionally, when sand control screen assembly 160 is used during production, production fluids are allowed to flow into sand control screen assembly 160 by seal member 186 in its non sealing position or disabled position. Further, when sand control screen assembly 160 of the present invention is used during a subsequent treatment process, seal member 186 may be disabled.

In addition to these features, upper section 170 of isolation member 168 of sand control screen assembly 160 is retrievable. Specifically, upper section 170 of isolation member 168 includes a profile 212 that receives a matching profile of a retrieval tool. As discussed above, following the treatment precesses wherein fluid flow from the interior to the exterior of sand control screen assembly 160 is prevented, the ability to flow fluids from the interior to the exterior of sand control screen assembly 160 may be desirable. In the illustrated embodiment, a retrieval tool is run downhole via a wireline or other suitable conveyance and locked into profile 212 such that jarring in the uphole direction on upper section 170 of isolation member 168 will break shear pins 180 and allow upper section 170 of isolation member 168 to be retrieved to the surface, thereby placing sand control screen assembly 160 in a valve open configuration. Thereafter, a subsequent treatment process such as an acid treatment may be performed with direct fluid communication between the interior of sand control screen assembly 160 and openings 164 of base pipe 162.

Figure 7:
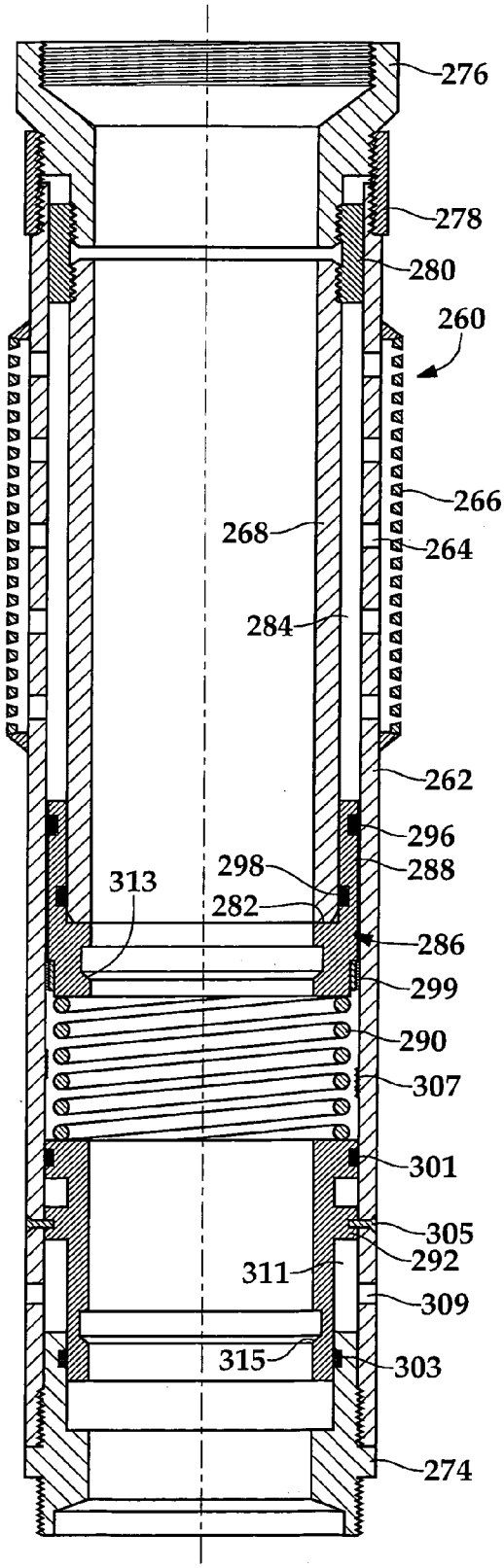
FIG. 7 is a half sectional view of a further embodiment of a sand control screen assembly of the present invention having a seal member.

Referring now to FIG. 7, therein is depicted another embodiment of a sand control screen assembly of the present invention that is generally designated 260. Sand control screen assembly 260 includes a base pipe 262 that has a plurality of openings 264 which allow the flow of production fluids into sand control screen assembly 260. Positioned exteriorly of base pipe 262 is a filter medium 266. Positioned within base pipe 262 is an internal isolation member 268. In the illustrated embodiment, base pipe 262 is threadably coupled to a lower connector 274. At the opposite end, base pipe 262 is threadably coupled to upper connector 276 via coupling 278. Upper connector 276 is threadably coupled to isolation member 268 via a coupling 280. Upper section 270 has a lower end 282 that is in fluid communication with the interior of sand control screen assembly 260.

Base pipe 262 and isolation member 268 are attached to upper connector 276 such that an annulus 284 is formed between base pipe 262 and isolation member 268. Partially disposed within annulus 284 is a seal member 286 that performs the functions of a one-way valve and an open valve. Seal member 286 includes a shuttle valve 288, a biasing member 290 and a spring retainer 292. Shuttle valve 288 has a seal 296 positioned on the exterior thereof that provides a seal against an interior sealing surface of base pipe 262. Shuttle valve 288 also has a seal 298 positioned on the interior thereof that provides a seal against the exterior sealing surface of isolation member 268.

Positioned between shuttle valve 288 and base pipe 262 is a keeper ring 299. Spring retainer 292 has a seal 301 positioned on the exterior thereof that provides a seal against the interior sealing surface of base pipe 262. Lower connector 274 has a seal 303 positioned on the interior thereof that provides a seal against the exterior sealing surface of spring retainer 292. In the illustrated embodiment, a plurality of shear pins 305 extend through openings of base pipe 262 and initially into a shear pin receiving groove in the exterior surface of spring retainer 292. Base pipe 262 also has a mating profile 307 and a fluid port 309 that is in communication with a chamber 311 formed between base pipe 262 and spring retainer 292.

The operation of sand control screen assembly 260 is substantially the same as that of sand control screen assembly 60 described above. Specifically, when sand control screen assembly 260 of the present invention is used during a treatment process such as a gravel pack, a frac pack or a fracture operation, treatment fluid returns are allowed to flow into sand control screen assembly 260 by seal member 286 in its non sealing position. Also, when sand control screen assembly 260 of the present invention is used following a treatment process, fluids are prevented from flowing from the interior to the exterior of sand control screen assembly 260 by seal member 286 in its sealing position. Additionally, when sand control screen assembly 260 is used during production, production fluids are allowed to flow into sand control screen assembly 260 by seal member 286 in its non sealing or disabled position. Further, when sand control screen assembly 260 of the present invention is used during a subsequent treatment process, seal member 286 may be disabled.

In this embodiment, in addition to disabling shuttle valve 288 using a pressure sequence as described above with reference to shuttle valve 88, shuttle valve 288 may be disabled by mechanical means. To achieved this result, shuttle valve 288 includes mating profile 313 and spring retainer 292 includes a mating profile 315. A shifting tool that is run downhole via wireline or other suitable conveyance is locked into profile 315 such that jarring in either the upward or downward directions will break shear pins 305. Thereafter, the shifting tool is locked into profile 313 such that downward jarring will shift shuttle valve 288 downwardly until keener ring 299 engages mating profile 307 to secure shuttle valve 288 in the disabled position.

Figure 8:
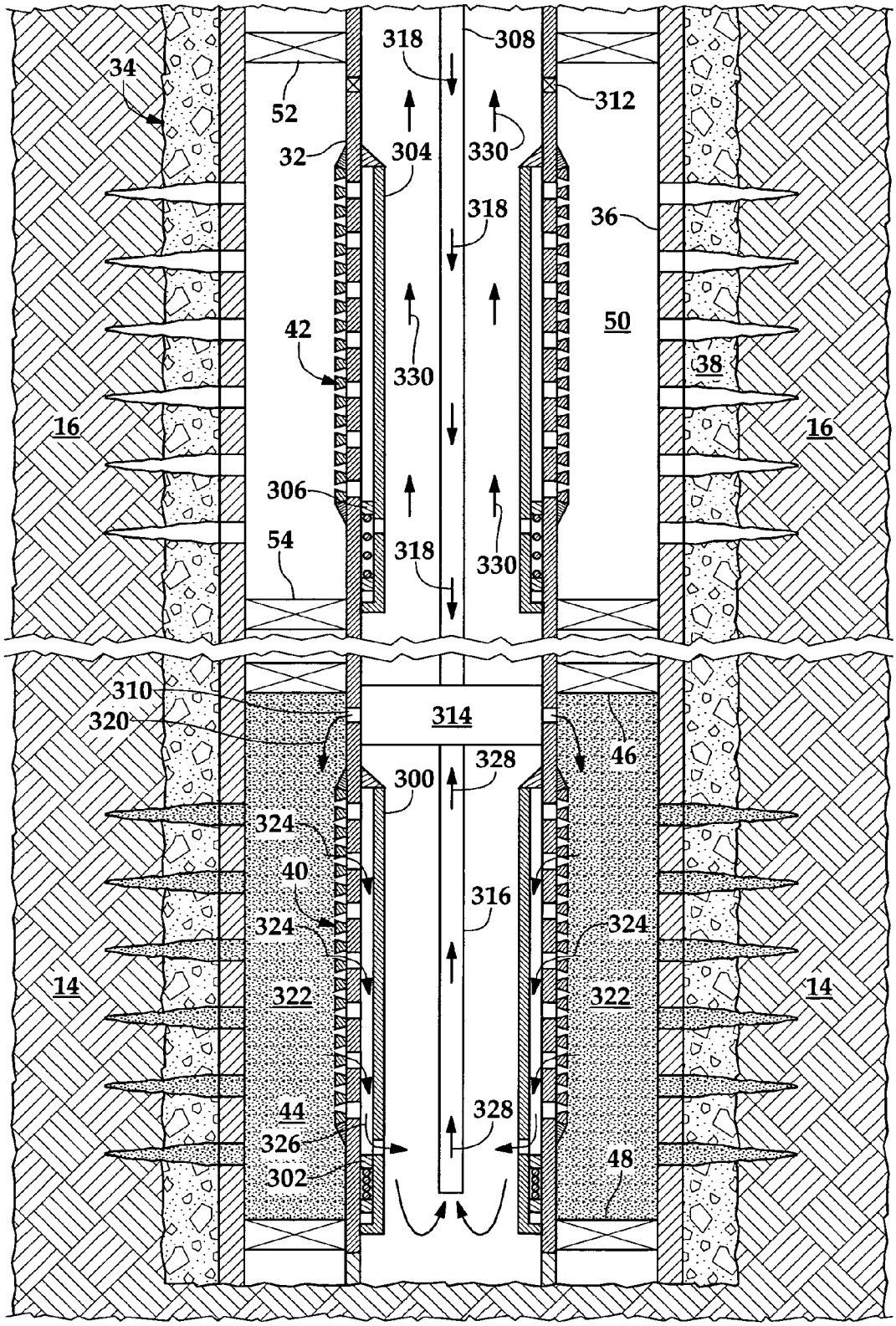
FIG. 8 is a half sectional view of a downhole production environment including a pair of sand control screen assemblies of the present invention during a first phase of a downhole treatment process.

Referring now to FIG. 8, therein is depicted in more detail the downhole environment described above with reference to FIG. 1 during a treatment process such as a gravel pack, a fracture operation, a frac pack or the like. As illustrated, sand control screen assembly 40 including internal isolation member 300 having a seal member 302 slidably operable in the annulus between internal isolation member 300 and the base pipe of sand control screen assembly 40, is positioned within casing 36 and is adjacent to formation 14. Likewise, sand control screen assembly 42 including internal isolation member 304 having a seal member 306 slidably operable in the annulus between internal isolation member 304 and the base pipe of sand control screen assembly 42, is positioned within casing 36 and is adjacent to formation 16. A service tool 308 is positioned within the work string 32.

To begin the treatment process, production interval 44 adjacent to formation 14 is isolated. Packer 46 seals the near or uphole end of production interval 44 and packer 48 seals the far or downhole end of production interval 44. Likewise, production interval 50 adjacent to formation 16 is isolated. Packer 52 seals the near end of production interval 50 and packer 54 seals the far end of production interval 50. Work string 32 includes crossover ports 310, 312 that provide a fluid communication path from the interior of work string 32 to production intervals 44, 50, respectively. Preferably, fluid flow through crossover ports 310, 312 is controlled by suitable valves that are opened and closed by conventional means. Service tool 308 includes a crossover assembly 314 and a wish pipe 316.

Next, the desired treatment process may be performed. As an example, when the treatment process is a fracture operation, the objective is to enhance the permeability of the treated formation by delivering a fluid slurry containing proppants at a high flow rate and in a large volume above the fracture gradient of the formation such that fractures may be formed within the formation and held open by proppants. In addition, if the treatment process is a frac pack, after fracturing, the objective is to prevent the production of fines by packing the production interval with proppants. Similarly, if the treatment process is a gravel pack, the objective is to prevent the production of fines by packing the production interval with gravel, without fracturing the adjacent formation.

The following example will describe the operation of the present invention during a gravel pack operation. Sand control screen assemblies 40, 42 each have a filter medium associated therewith that is designed to allow fluid to flow therethrough but prevent particulate matter of sufficient size from flowing therethrough. The exact design of the filter medium of sand control screen assemblies 40, 42 is not critical to the present invention as long as it is suitably designed for the characteristics of the formation fluids and the treatment fluids.

During the gravel pack, a treatment fluid, in this case a fluid slurry containing gravel, is pumped downhole in service tool 308, as indicated by arrows 318, and into production interval 44 via crossover assembly 314, as indicated by arrows 320. As the fluid slurry containing gravel travels to the far end of production interval 44, the gravel drops out of the slurry and builds up from formation 14, filling the perforations and production interval 44 around sand control screen assembly 40 forming gravel pack 322. While some of the carrier fluid in the slurry may leak off into formation 14, the remainder of the carrier fluid passes through sand control screen assembly 40, as indicated by arrows 324 and through seal member 302, as indicated by arrows 326. The fluid flowing back through sand control screen assembly 40 enters wash pipe 316, as indicated by arrows 328, passes through crossover assembly 314 and flows back to the surface, as indicated by arrows 330.

Figure 9:
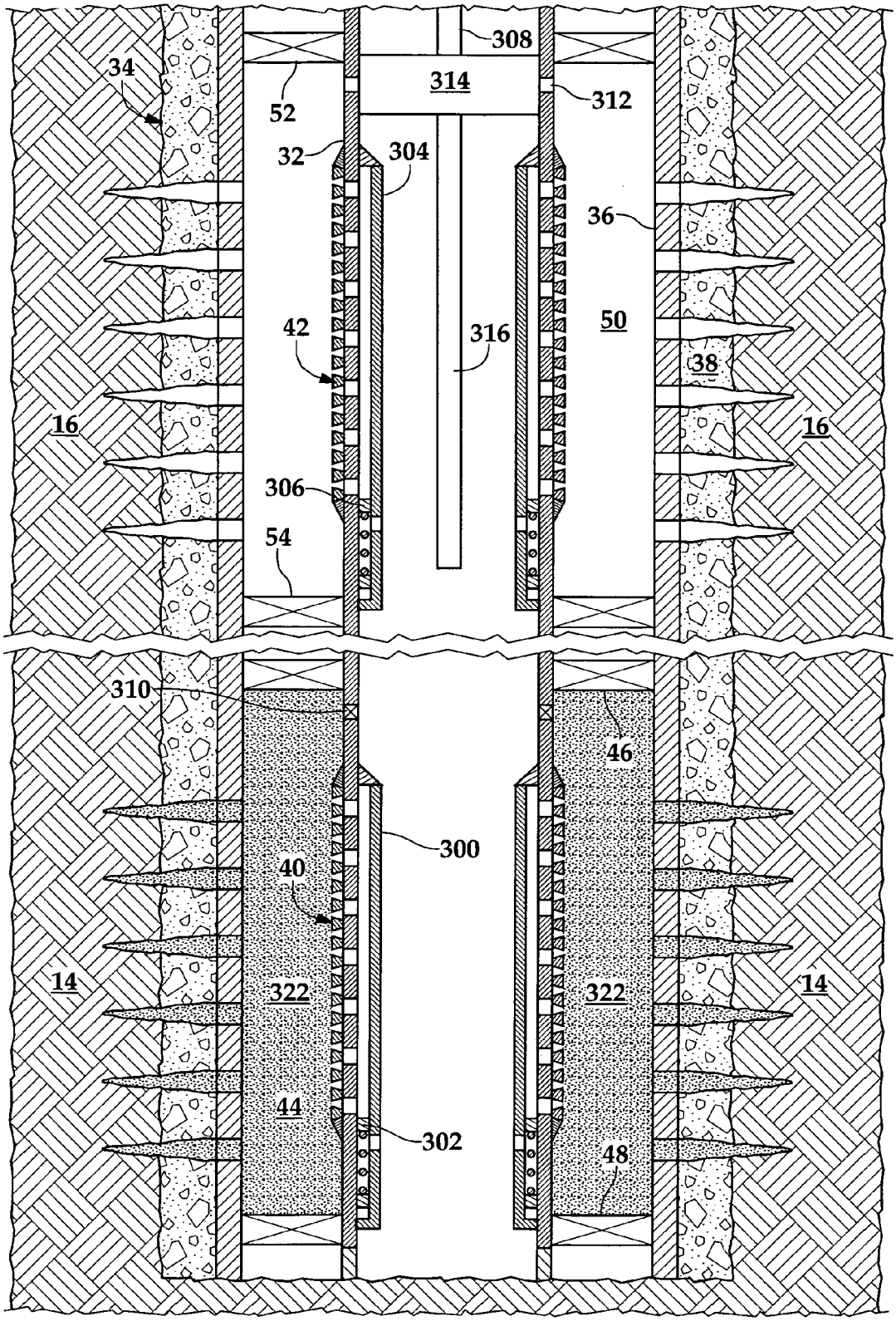
FIG. 9 is a half sectional view of a downhole production environment including a pair of sand control screen assemblies of the present invention during a second phase of a downhole treatment process.

After the gravel packing operation of production interval 44 is complete, service tool 308 including crossover assembly 314 and wash pipe 316 may be moved uphole such that other production intervals may be gravel packed, such as production interval 50, as best seen in FIG. 9. As the distance between formation 14 and formation 16 may be hundreds or even thousands of feet and as there may be any number of production intervals that require gravel packing, there may be a considerable amount of time between the gravel packing of production interval 44 and eventual production from formation 14. It has been found that in conventional completions, considerable fluid loss may occur from the interior of sand control screen assembly 40 through gravel pack 322 and into formation 14. This fluid loss is not only costly but may also damage gravel pack 322, formation 14 or both. Using the sand control screen assemblies of the present invention, however, prevents such fluid loss due to the one-way valve capabilities of seal member 302 positioned within sand control screen assembly 40. Accordingly, using the sand control screen assemblies of the present invention not only save the expense associated with fluid loss but also protect gravel pack 322 and formation 14 from the damage caused by fluid loss.

Figure 10:
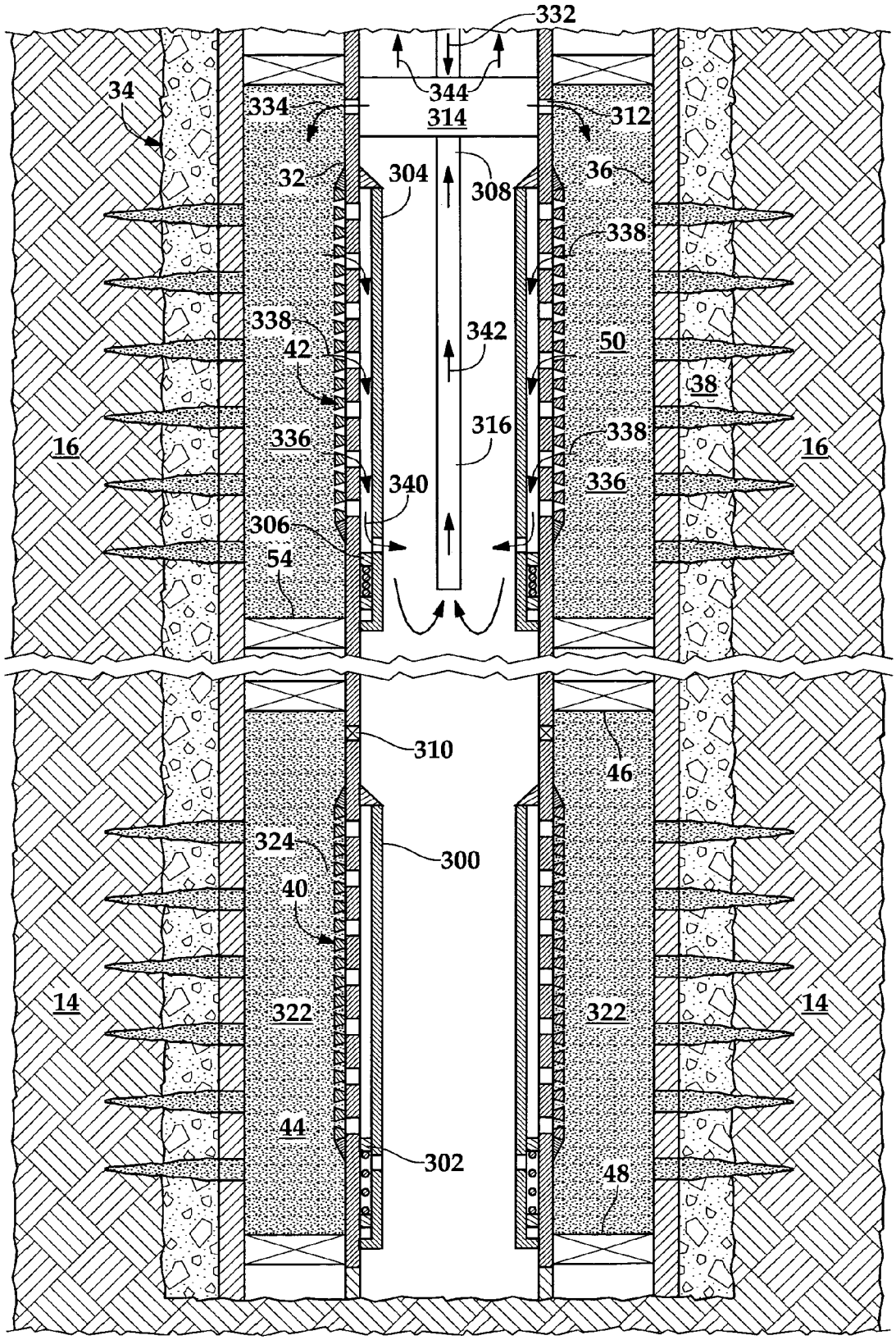
FIG. 10 is a half sectional view of a downhole production environment including a pair of sand control screen assemblies of the present invention during a third phase of a downhole treatment process.

Referring to FIG. 10, the process of gravel packing production interval 50 is depicted. The fluid slurry containing gravel is pumped downhole through work string 32, as indicated by arrows 332, and into production interval 50 via crossover assembly 314 and crossover ports 312, as indicated by arrows 334. As the fluid slurry containing gravel travels to the far end of production interval 50, the gravel drops out of the slurry and builds up from formation 16, filling the perforations and production interval 50 around sand control screen assembly 42 forming gravel pack 336. While some of the carrier fluid in the slurry may leak off into formation 16, the remainder of the carrier fluid passes through sand control screen assembly 42 as indicated by arrows 338 and through seal member 306, as indicated by arrows 340. The fluid flowing back through sand control screen assembly 42 enters wash pipe 316, as indicated by arrows 342, and passes through crossover assembly 314 for return to the surface, as indicated by arrows 344. Once gravel pack 336 is complete, crossover assembly 308 may again be repositioned uphole to gravel pack additional production intervals or retrieved to the surface. As explained above, using sand control screen assembly 42 prevents fluid loss from the interior of sand control screen assembly 42 to formation 16 during such subsequent operations.

As should be apparent to those skilled in the art, even though FIGS. 8–10 present the treatment of multiple intervals of a wellbore in a vertical orientation with packers at the top and bottom of the production interval, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly positionable within a wellbore comprising:

a base pipe having at least one opening that allows fluid flow therethrough;

a filter medium positioned exteriorly of the base pipe, the filter medium selectively allowing fluid flow therethrough and preventing particulate flow of a predetermined size therethrough;

an isolation member positioned interiorly of the base pipe and forming an annular region therewith; and a seal member slidably operable within the annular region, the seal member controlling fluid flow between the exterior and the interior of the sand control screen assembly, the seal member having a one-way valve configuration and a Valve open configuration wherein fluid flow from the interior to the exterior of the sand control screen assembly and from the exterior to the interior of the sand control screen assembly is allowed.

2. The sand control screen assembly as recited in claim 1 wherein the seal member prevents fluid loss from the interior to the exterior of the sand control screen assembly in the one-way valve configuration.

3. The sand control screen assembly as recited in claim 1 wherein the seal member is operable from the one-way valve configuration to the valve open configuration responsive to a differential pressure between the interior and the exterior of the sand control screen assembly that exceeds a predetermined threshold.

4. The sand control screen assembly as recited in claim 1 wherein the seal member further comprises a spring retainer, a biasing member and a shuttle valve.

5. The sand control screen assembly as recited in claim 4 wherein the spring retainer is in a first position relative to the base pipe when the seal member is in the one-way valve configuration such that the biasing member urges the shuttle valve into a sealing position.

6. The sand control screen assembly as recited in claim 5 wherein the spring retainer is in a second position relative to the base pipe when the seal member is in the valve open configuration such that the biasing member does not urge the shuttle valve into the sealing position.

7. The sand control screen assembly as recited in claim 6 wherein the spring retainer is releasably secured to one of the base pipe and the isolation member with at least one shear pin when the spring retainer is in the first position.

8. The sand control screen assembly as recited in claim 6 wherein the spring retainer is operated from the first position to the second position by the application of a differential pressure above a predetermined threshold between the interior and the exterior of the sand control screen assembly.

9. The sand control screen assembly as recited in claim 6 wherein the spring retainer is operated from the first position to the second position by mechanically shifting the spring retainer relative to the base pipe.

10. The sand control screen assembly as recited in claim 6 wherein the spring retainer is secured to one of the base pipe and the isolation member with at least one collet finger when the spring retainer is in the second position.

11. The sand control screen assembly as recited in claim 4 wherein the shuttle valve has a sealing position and a non sealing position when the seal member is in the one-way valve configuration.

12. The sand control screen assembly as recited in claim 11 wherein the shuttle valve has a disabled position when the seal member is in the valve open configuration.

13. The sand control screen assembly as recited in claim 12 wherein the shuttle valve is secured to the base pipe with a keeper ring when the shuttle valve is in the disabled position.

14. The sand control screen assembly as recited in claim 12 wherein the shuttle valve is operated to the disabled position responsive to a differential pressure above a predetermined threshold between the exterior and the interior of the sand control screen assembly.

15. The sand control screen assembly as recited in claim 12 wherein the shuttle valve is operated to the disabled position by mechanically shifting the shuttle valve relative to the base pipe.

16. The sand control screen assembly as recited in claim 1 wherein the isolation member further comprises a tubular having at least one opening.

17. The sand control screen assembly as recited in claim 1 wherein the isolation member further comprises a pair of tubulars having a gap therebetween.

18. The sand control screen assembly as recited in claim 1 wherein the isolation member further comprises a tubular having an end in fluid communication with the interior of the sand control screen.

19. The sand control screen assembly as recited in claim 1 wherein at least a portion of the internal isolation member is retrievable from within the base pipe allowing fluid flow from the interior to the exterior and from the exterior to the interior of the sand control screen assembly.

20. A sand control screen assembly positionable within a wellbore comprising:

a base pipe having at least one opening that allows fluid flow therethrough;

a filter medium positioned exteriorly of the base pipe, the filter medium selectively allowing fluid flow therethrough and preventing particulate flow of a predetermined size therethrough;

an isolation member positioned interiorly of the base pipe and forming an annular region therewith; and a one-way valve slidably operable within the annular region, the one-way valve controlling fluid flow between the exterior and the interior of the sand control screen assembly, wherein at least a portion of the isolation member is retrievable from within the base pipe allowing fluid flow from the interior to the exterior and from the exterior to the interior of the sand control screen assembly.

21. The sand control screen assembly as recited in claim 20 wherein the one-way valve has a non sealing position and a sealing position.

22. The sand control screen assembly as recited in claim 21 wherein the one-way valve prevents fluid flow from the interior to the exterior of the sand control screen assembly in the sealing position.

23. The sand control screen assembly as recited in claim 22 wherein the one-way valve is actuatable to the non sealing position to allow fluid flow from the exterior to the interior of the sand control screen assembly.

24. The sand control screen assembly as recited in claim 20 wherein the isolation member further comprises a tubular having at least one opening.

25. The sand control screen assembly as recited in claim 20 wherein the isolation member further comprises a pair of tubulars having a gap therebetween.

26. The sand control screen assembly as recited in claim 20 wherein the isolation member further comprises a tubular having an end in fluid communication with the interior of the sand control screen.

27. The sand control screen assembly as recited in claim 20 wherein the one-way valve further comprises a spring retainer, a biasing member and a shuttle valve.

28. The sand control screen assembly as recited in claim 27 wherein the biasing member urges the shuttle valve into a sealing position.

29. A downhole treatment method comprising the steps of:

locating a sand control screen assembly within a production interval of a wellbore, the sand control screen assembly including a base pipe having at least one opening, a filter medium positioned exteriorly of the base pipe and an isolation member positioned interiorly of the base pipe and forming an annular region therewith;

pumping a treatment fluid into the production interval;

allowing fluid returns to enter the interior of the sand control screen assembly by slidably actuating a seal member disposed in the annular region to a non sealing position of a one-way valve configuration;

preventing fluid loss from the interior to the exterior of the sand control screen assembly with the seal member in a sealing position of the one-way valve configuration;

allowing production fluids to enter the interior of the sand control screen assembly by slidably actuating the seal member to the non sealing position;

operating the seal member from the one-way valve configuration to a valve open configuration;

allowing fluid flow from the interior to the exterior of the sand control screen assembly; and retrieving at least a portion of the isolation member from within the base pipe.

30. The method as recited in claim 29 wherein the step of pumping a treatment fluid into the production interval further comprises performing a treatment selected from the group consisting of gravel packing, fracturing and frac packing.

31. The method as recited in claim 29 wherein the step of allowing production fluids to enter the interior of the sand control screen assembly further comprises overcoming a bias force to slidably actuate the seal member to the non sealing position.

32. The method as recited in claim 29 wherein the step of allowing production fluids to enter the interior of the sand control screen assembly further comprises overcoming a bias force to slidably actuate the seal member to the non sealing position.

33. The method as recited in claim 29 wherein the step of preventing fluid loss from the interior to the exterior of the sand control screen assembly further comprises applying a bias force to slidably actuate the seal member to the sealing position.

34. The method as recited in claim 29 wherein the step of preventing fluid loss from the interior to the exterior of the sand control screen assembly further comprises applying a differential pressure between the interior and the exterior of the sand control screen assembly.

35. The method as recited in claim 29 wherein the step of operating the seal member from the one-way valve configuration to the valve open configuration further comprises applying a differential pressure between the interior and the exterior of the sand control screen assembly that exceeds a predetermined threshold.

36. The method as recited in claim 35 wherein the step of operating the seal member from the one-way valve configuration to the valve open configuration further comprises applying a differential pressure between the exterior and the interior of the sand control screen assembly that exceeds a predetermined threshold.

37. The method as recited in claim 29 wherein the step of operating the seal member from the one-way valve configuration to the valve open configuration further comprises mechanically operating the seal member from the one-way valve configuration to the valve open configuration.

38. A downhole treatment method comprising the steps of:

locating a sand control screen assembly within a production interval of a wellbore, the sand control screen assembly including a base pipe having at least one opening, a filter medium positioned exteriorly of the base pipe and an isolation member positioned interiorly of the base pipe and forming an annular region therewith;

pumping a treatment fluid into the production interval;

allowing fluid returns to enter the interior of the sand control screen assembly by slidably actuating a one-way valve disposed in the annular region to a non sealing position;

preventing fluid loss from the interior to the exterior of the sand control screen assembly with the one-way valve in a sealing position;

allowing production fluids to enter the interior of the sand control screen assembly by slidably actuating the one-way valve to the non sealing position; and retrieving at least a portion of the isolation member from within the base pipe.

39. The method as recited in claim 38 wherein the step of pumping a treatment fluid into the production interval further comprises performing a treatment selected from the group consisting of gravel packing, fracturing and frac packing.

40. The method as recited in claim 38 wherein the step of allowing production fluids to enter the interior of the sand control screen assembly further comprises overcoming a bias force to slidably actuate the one-way valve to the non sealing position.

41. The method as recited in claim 38 wherein the step of allowing production fluids to enter the interior of the sand control screen assembly further comprises overcoming a bias force to slidably actuate the one-way valve to the non sealing position.

42. The method as recited in claim 38 wherein the step of preventing fluid loss from the interior to the exterior of the sand control screen assembly further comprises applying a bias force to slidably actuate the one way valve to the sealing position.

43. The method as recited in claim 38 wherein the step of preventing fluid loss from the interior to the exterior of the sand control screen assembly further comprises applying a differential pressure between the interior and the exterior of the sand control screen assembly.

* * * * *